US010011461B2

(12) United States Patent
Valjus

(10) Patent No.: US 10,011,461 B2
(45) Date of Patent: Jul. 3, 2018

(54) ELEVATOR

(71) Applicant: KONE Corporation, Helsinki (FI)

(72) Inventor: Petteri Valjus, Helsinki (FI)

(73) Assignee: KONE CORPORATION, Helsinki (FI)

( * ) Notice: Subject to any disclaimer, the term of this patent is extended or adjusted under 35 U.S.C. 154(b) by 532 days.

(21) Appl. No.: 14/454,803

(22) Filed: Aug. 8, 2014

(65) Prior Publication Data

US 2015/0053506 A1 Feb. 26, 2015

(30) Foreign Application Priority Data

Aug. 26, 2013 (EP) ..... 13181678

(51) Int. Cl.
*B66B 9/00* (2006.01)
*B66B 7/06* (2006.01)
*B66B 11/00* (2006.01)

(52) U.S. Cl.
CPC ..... *B66B 7/062* (2013.01); *B66B 11/008* (2013.01); *B66B 11/0045* (2013.01)

(58) Field of Classification Search
CPC .... B66B 7/062; B66B 11/0045; B66B 11/008
(Continued)

(56) References Cited

U.S. PATENT DOCUMENTS 3,101,130 A * 8/1963 Bianca ..... B66B 11/08 187/244
5,429,211 A * 7/1995 Aulanko ..... B66B 11/002 187/254
(Continued)

FOREIGN PATENT DOCUMENTS

CN 1960934 A 5/2007
CN 100542931 C 9/2009
(Continued)

OTHER PUBLICATIONS

European Search Report dated Mar. 31, 2014, issued in European Patent Application No. EP 13 19 1600, in English language.

*Primary Examiner* — Michael A Riegelman
(74) *Attorney, Agent, or Firm* — Birch, Stewart, Kolasch & Birch, LLP

(57) ABSTRACT

An elevator includes an elevator car; a counterweight; a drive wheel mounted stationary, and having a rotational axis; first diverting wheel(s), mounted on the elevator car, and having a rotational axis parallel with the rotational axis of the drive wheel; a second and a third diverting wheel mounted on the counterweight radially side by side, each having a rotational axis, which is at an angle of 60 to 90 degrees relative to the rotational axis of the drive wheel; a roping suspending the elevator car and counterweight and including a first belt-like rope and a second belt-like rope, each having a first end and a second end fixed to a stationary rope fixing, and each comprising one or more load bearing members made of fiber-reinforced composite material; wherein the first rope and the second rope are arranged to pass side by side from the fixing of the first end downwards to the elevator car; and to turn side by side under said first diverting wheel(s); and to pass upwards to the drive wheel; and to turn side by side over the drive wheel; and to pass downwards to the counterweight, each rope turning around its longitudinal axis an angle of 60 to 90 degrees, and into the gap between the rims of the second and third diverting wheel, the first rope passing to the second diverting wheel and the second rope passing to the third diverting wheel, the first rope passing under the second diverting wheel and the second rope passing under the third diverting wheel, the diverting wheels rotating in opposite directions guiding the ropes arriving to them from the drive wheel to turn away
(Continued)

from each other; and to pass upwards to the fixing of the second end.

16 Claims, 4 Drawing Sheets

(58) Field of Classification Search
USPC ..... 187/266
See application file for complete search history.

(56) References Cited

U.S. PATENT DOCUMENTS

| | | | | |
|---|---|---|---|---|
| 6,471,012 | B2 * | 10/2002 | Faletto | B66B 11/008 187/256 |
| 6,598,707 | B2 * | 7/2003 | Nakagaki | B66B 11/008 187/254 |
| 6,742,628 | B2 * | 6/2004 | Bauer | B66B 11/008 187/254 |
| 7,156,209 | B2 * | 1/2007 | Koeppe, Jr. | B66B 11/008 187/250 |
| 7,207,421 | B2 | 4/2007 | Aulanko et al. | |
| 7,293,631 | B2 * | 11/2007 | Ishii | B66B 11/008 187/250 |
| 7,481,299 | B2 | 1/2009 | Mustalahti et al. | |
| 7,549,514 | B2 * | 6/2009 | Heggli | B66B 7/021 187/256 |
| 7,753,175 | B2 | 7/2010 | Fanion et al. | |
| 7,806,238 | B2 | 10/2010 | Fischer | |
| 9,321,612 | B2 * | 4/2016 | Fargo | B66B 11/008 |
| 9,371,212 | B2 * | 6/2016 | Yapar | B66B 11/008 |
| 9,487,378 | B2 * | 11/2016 | Lin | B66B 11/008 |
| 2002/0070080 | A1 | 6/2002 | Nakagaki et al. | |
| 2004/0108170 | A1 * | 6/2004 | Kocher | B66B 7/021 187/254 |
| 2004/0129501 | A1 * | 7/2004 | Wittur | B66B 11/008 187/254 |
| 2005/0115799 | A1 | 6/2005 | Ach et al. | |
| 2006/0016641 | A1 | 1/2006 | Koeppe, Jr. | |
| 2006/0151251 | A1 * | 7/2006 | Rennetaud | B66B 11/0438 187/254 |
| 2007/0170003 | A1 * | 7/2007 | Izumi | B66B 11/008 187/250 |
| 2008/0121468 | A1 * | 5/2008 | Fischer | B66B 11/008 187/256 |
| 2008/0277207 | A1 * | 11/2008 | Kawasaki | B66B 11/008 187/266 |
| 2009/0114487 | A1 * | 5/2009 | Bjorni | B66B 19/02 187/412 |
| 2010/0072000 | A1 * | 3/2010 | Lin | B66B 11/008 187/266 |
| 2011/0000746 | A1 | 1/2011 | Pelto-Huikko et al. | |
| 2011/0278095 | A1 | 11/2011 | Ketonen et al. | |
| 2012/0085594 | A1 * | 4/2012 | Wright | B66B 11/008 187/266 |
| 2012/0090144 | A1 | 4/2012 | Leckman et al. | |
| 2015/0266702 | A1 * | 9/2015 | Suoranta | B66B 9/00 187/266 |

FOREIGN PATENT DOCUMENTS

| | | | |
|---|---|---|---|
| CN | 101977834 | A | 2/2011 |
| CN | 102282088 | A | 12/2011 |
| DE | 201 22 517 | U1 | 1/2006 |
| EP | 1 550 629 | A1 | 11/2004 |
| EP | 2 022 744 | A1 | 2/2009 |
| FI | 20125078 | A | 7/2013 |
| JP | 2010-500257 | A | 1/2010 |
| JP | 2011-509899 | A | 3/2011 |
| RU | 2 349 533 | C2 | 3/2009 |
| WO | WO 2004/041699 | A1 | 5/2004 |
| WO | 2009/090299 | A1 | 7/2009 |
| WO | WO 2010/081935 | A1 | 7/2010 |

* cited by examiner

ELEVATOR

FIELD OF THE INVENTION

The invention relates to an elevator. The elevator is particularly meant for transporting passengers and/or goods.

BACKGROUND OF THE INVENTION

An elevator typically comprises a hoistway S, an elevator car and a counterweight both vertically movable in the hoistway, and a drive machine M which drives the elevator car under control of an elevator control system. The drive machine typically comprises a motor and a drive wheel engaging an elevator roping, which is connected to the car. Thus, driving force can be transmitted from the motor to the car via the drive wheel and the roping. The roping passes around the drive wheel and suspends the elevator car and the counterweight and comprises a plurality of ropes connecting the elevator car and the counterweight. The roping can be connected to the car and counterweight via diverting wheels. This results in a lifting ratio of 2:1 or greater for these elevator units, depending on via how many diverting wheels the elevator unit in question is suspended. There are several reasons for choosing a high lifting ratio. Importantly, this kind of lifting ratio can be used as a means for increasing the rotational speed of the motor of the drive machine relative to the traveling speed of the car, which is advantageous especially in case of elevators where the drive machine must be dimensioned small in size, or in case of elevators with gearless connection between the motor and drive wheel or in case of elevators with need for reducing torque producing capacity from the motor. It is a common goal in modern elevators to position the drive machine in the top part of the hoistway. By providing said advantages, using the lifting ratio of 2:1 or greater facilitates achieving this goal.

The bending radius of the ropes sets limits for the overall structure of the elevator. For instance the diverting wheels must have a diameter suitable for the ropes. This affects the space efficiency of the elevator and it has been difficult to design an elevator of simple and space efficient structure if the bending radius of the rope is high. For this reason the rope number has been high, and the rope material and structure selected so that a small bending radius can be provided. This effect is relevant especially with elevators having a lifting ratio of 2:1 or higher, because the ropes need to pass around diverting wheels. Thereby, it has been difficult to use ropes which require high bending radius in this type of elevators.

In the elevators of prior art as described above, it is typical to use a roping, which has a great number of metallic load bearing members in the form of twisted steel wires. A roping of this kind has its advantages such as low cost and small bending radius due to twisted structure. However, a metallic roping is heavy and often requires use of a compensation roping to compensate masses of the suspension roping. A drawback of this kind of elevator is therefore that the great rope mass reduces energy efficiency and increases complexity of the elevator construction. The known ropes also have a longitudinal stiffness of a scale that requires use a great number of ropes so as to achieve the desired total load bearing capability, which makes the elevator more complicated.

BRIEF DESCRIPTION OF THE INVENTION

The object of the invention is, inter alia, to solve previously described drawbacks of known solutions and problems discussed later in the description of the invention. The object of the invention is to introduce a new elevator of 2:1 suspension ratio. An object is, in particular, to introduce an elevator having a simple and space-efficient overall structure despite a high bending radius of the ropes. Embodiments are presented, inter alia, where this goal is achieved with light-weighted ropes, thus making the elevator energy-efficient.

It is brought forward a new elevator, which comprises an elevator car;

a counterweight;

a drive wheel mounted stationary, and having a rotational axis;

first diverting wheel(s), mounted on the elevator car, and having a rotational axis parallel with the rotational axis of the drive wheel;

a second and a third diverting wheel mounted on the counterweight radially side by side, each having a rotational axis, which is at an angle of 60 to 90 degrees relative to the rotational axis of the drive wheel;

a roping suspending the elevator car and counterweight and comprising a first belt-like rope and a second belt-like rope, each having a first end and a second end fixed to a stationary rope fixing, and each comprising one or more load bearing members made of fiber-reinforced composite material;

wherein the first rope and the second rope are arranged to pass side by side from the fixing of the first end downwards to the elevator car; and to turn side by side under said first diverting wheel(s); and to pass upwards to the drive wheel; and to turn side by side over the drive wheel; and to pass downwards to the counterweight, each rope turning around its longitudinal axis an angle of said 60 to 90 degrees (i.e. the same angle as the aforementioned angle of the second and third diverting wheel), and into the gap between the rims of the second and third diverting wheel, the first rope passing to the second diverting wheel and the second rope passing to the third diverting wheel, the first rope passing under the second diverting wheel and the second rope passing under the third diverting wheel, the second and third diverting wheels rotating in opposite directions guiding the ropes to turn away from each other; and to pass upwards to the fixing of the second end.

With this kind of configuration one or more of the aforementioned objectives are achieved. In particular, a new elevator of 2:1 suspension ratio with fiber reinforced composite ropes is achieved with a simple and space-efficient overall structure despite the high bending radius of the ropes.

In a preferred embodiment each of said load bearing member(s) has width larger than thickness thereof as measured in width-direction of the rope.

In a preferred embodiment said fiber-reinforced composite material comprises reinforcing fibers in polymer matrix.

In a preferred embodiment said one or more load bearing members is/are embedded in elastomeric coating.

In a preferred embodiment the roping comprises only said two ropes, i.e. only said first and second rope.

In a preferred embodiment the drive wheel is mounted in the top end of the hoistway.

In a preferred embodiment the counterweight travels vertically on the backside of the vertically traveling car. Particularly, the car travels vertically between the counterweight and the landing doors. The car has also a door on the side of the car opening to the front direction.

In a preferred embodiment the ropes pass from the drive wheel turning around their longitudinal axes in opposite turning directions.

In a preferred embodiment said angle of 60 to 90 degrees is less than 90 degrees, preferably an angle within the range of 60 to 85 degrees, most preferably an angle within the range of 75 to 85 degrees. Thus, the risk of fracturing of the composite rope structure caused by the axial twist of the rope, can be reduced. In a first related alternative, the first rope passes downwards turning clockwise and the second rope passes downwards turning counterclockwise (when viewed from above). Said angle of 60 to 90 degrees is with the second diverting wheel an angle measured in clockwise direction and with the third diverting wheel an angle measured in counter-clockwise direction with respect to the rotational axis of the drive wheel. In a second related alternative, the first rope passes downwards turning counterclockwise and the second rope passes downwards turning clockwise (when viewed from above). Said angle of 60 to 90 degrees is with the second diverting wheel an angle measured in counter-clockwise direction and with the third diverting wheel an angle measured in clockwise direction with respect to the rotational axis of the drive wheel. With these alternatives, good results with regard to space consumption with reduced risk of fractures in the composite rope structure are obtained. Also, the suspension of the counterweight can thus be formed substantially central and without tendency to turn so that guiding resistance is increased.

In a preferred embodiment said angle of 60 to 90 degrees is 90 degrees.

In a preferred embodiment the second and third diverting wheels, i.e. the rope receiving circumference thereof, have diameter of 30 to 70 cm, most preferably 30 to 50 cm.

In a preferred embodiment the drive wheel, i.e. the rope receiving circumference thereof, has diameter of 30 to 70 cm, most preferably 30 to 50 cm.

In a preferred embodiment the roping comprises exactly two of said ropes passing around the drive wheel adjacent each other in width-direction of the rope the wide sides of the ropes against the drive wheel.

In a preferred embodiment each of said rope(s) comprises a plurality of said load bearing members adjacent in width-direction of the rope.

In a preferred embodiment the drive wheel is driven (rotated) by an electric motor under control of elevator control as a response to calls from passengers. Preferably, the drive wheel is coaxially connected to the rotor of the electric motor, the drive wheel being an extension of the rotor of the motor of the drive machine.

In a preferred embodiment each of said rope(s) has at least one contoured side provided with guide rib(s) and guide groove(s) oriented in the longitudinal direction of the rope or teeth oriented in the cross direction of the rope, said contoured side being fitted to pass against a circumference of the drive wheel contoured in a matching way i.e. so that the shape of the circumference forms a counterpart for the shapes of the ropes.

In a preferred embodiment each of said ropes has a wide side fitted to pass against the circumference of the drive wheel. Particularly, each of said ropes has a first wide side fitted to pass against the circumference of the drive wheel, and a second wide fitted to pass against the circumference of a first diverting wheel and one of said second and third diverting wheels.

In a preferred embodiment the load bearing member(s) of the rope cover(s) majority, preferably 70% or over, more preferably 75% or over, most preferably 80% or over, most preferably 85% or over, of the width of the cross-section of the rope. In this way at least majority of the width of the rope will be effectively utilized and the rope can be formed to be light and thin in the bending direction for reducing the bending resistance.

In a preferred embodiment the module of elasticity (E) of the polymer matrix is over 2 GPa, most preferably over 2.5 GPa, yet more preferably in the range 2.5-10 GPa, most preferably of all in the range 2.5-3.5 GPa. In this way a structure is achieved wherein the matrix essentially supports the reinforcing fibers, in particular from buckling. One advantage, among others, is a longer service life. The turning radius in this case is, formed so large that the above defined measures for coping with large turning diameter are especially advantageous.

In a preferred embodiment the load bearing members, as well as the reinforcing fibers are oriented in the lengthwise direction of the rope substantially untwisted relative to each other. The fibers are thus aligned with the force when the rope is pulled, which facilitates good rigidity under tension. Also, behaviour during bending is advantageous as the force transmitting parts retain their structure during bending. The wear life of the rope is, for instance long because no chafing takes place inside the rope. Preferably, individual reinforcing fibers are homogeneously distributed in said polymer matrix. Preferably, over 50% of the cross-sectional square area of the load-bearing member consists of said reinforcing fiber.

The elevator as describe anywhere above is preferably, but not necessarily, installed inside a building. The car is preferably arranged to serve two or more landings. The car preferably responds to calls from landing(s) and/or destination commands from inside the car so as to serve persons on the landing(s) and/or inside the elevator car. Preferably, the car has an interior space suitable for receiving a passenger or passengers.

BRIEF DESCRIPTION OF THE DRAWINGS

In the following, the present invention will be described in more detail by way of example and with reference to the attached drawings, in which.

DETAILED DESCRIPTION

Figure 1:
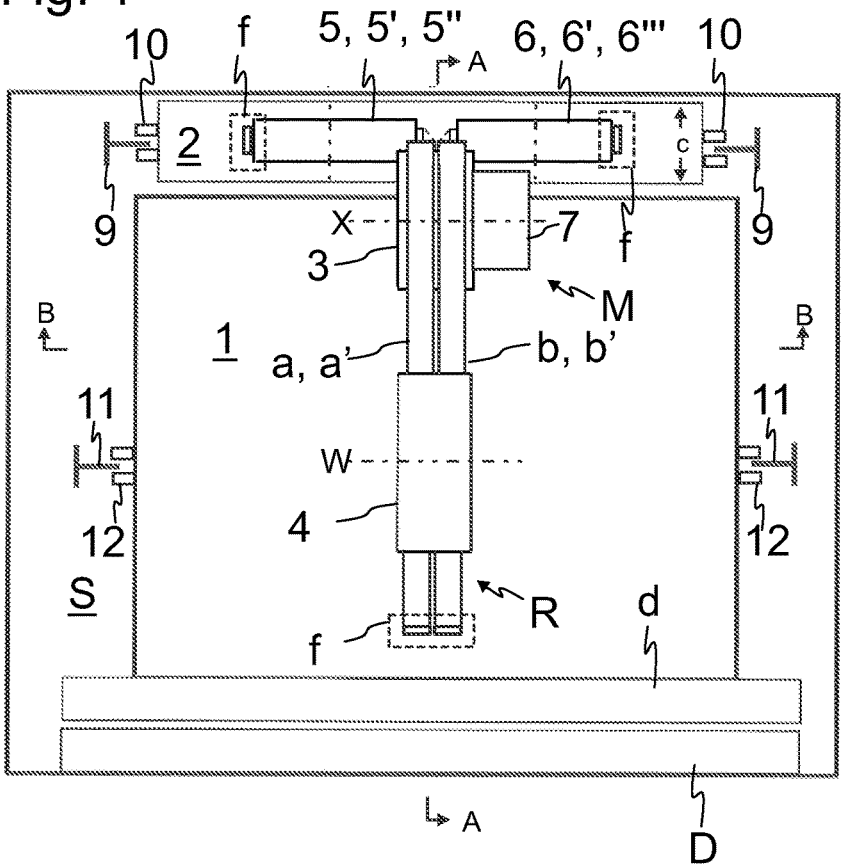
FIG. 1 illustrates schematically an elevator according to an embodiment of the invention.

FIG. 1 illustrates an elevator according to a preferred embodiment. The elevator comprises a hoistway S, an elevator car 1 and a counterweight 2 vertically movable in the hoistway S, and a drive machine M which drives the elevator car 1 under control of an elevator control system (not shown). The drive machine M is preferably mounted in the top end of the hoistway S, which makes the elevator easy to install in buildings without providing a separate machine room. The drive machine M comprises a motor 7 and a drive wheel 3. The drive wheel 3 is (along with the machine M) mounted stationary in the top end of the hoistway S to be positioned above the car 1 and counterweight 2, and has a horizontal rotational axis X. The drive wheel 3 engages an elevator roping R, which passes around the drive wheel 3 and suspends the elevator car 1 and the counterweight 2. Thus, driving force can be transmitted from the motor 7 to the car 1 and counterweight 2 via the drive wheel 3 and the roping R so as to move the car 1 and counterweight 2.

The elevator further comprises a first diverting wheel 4 or alternatively several wheels in the form of a pack of coaxial wheels 4, which first diverting wheel(s) is/are mounted on the elevator car 1, and have a horizontal rotational axis W parallel with the rotational axis X of the drive wheel 3. The first diverting wheel(s) are mounted on top of the car 1 substantially at the center of the vertical projection of the car. The elevator further comprises a second and a third diverting wheel 5, 6; 5', 6'; 5", 6" mounted on the counterweight 2 radially side by side, their rims at least substantially facing each other, each having a horizontal rotational axis Y, Z; Y', Z'; Y", Z", which is at an angle of 60 to 90 degrees relative to the rotational axis X of the drive wheel 3. The second and third diverting wheel 5, 6; 5', 6'; 5", 6" are mounted on top of the counterweight 2 so the ropes a, b; a', b' can be guided to meet their rims from up and depart from their rims back up. Using said wheels 3, 4, 5 and 6; 5' and 6'; 5" and 6" the roping R is guided to suspend the elevator car 1 and counterweight with 2:1 suspension ratio. Due to the angle of 60 to 90 degrees, the diverting wheels 5 and 6; 5' and 6'; 5" and 6" are positioned on the counterweight such that they do not (at least substantially) increase the vertical projection of the counterweight. Thus, their diameters can be great without increasing the space consumption of the vertically moving unity formed by the counterweight and the wheels 5, 6; 5', 6'; 5", 6". In particular, the diverting wheels 5, 6; 5', 6'; 5", 6" are mounted on the counterweight 2 adjacent each other in width direction of the counterweight 2, which direction is parallel with the back wall of the hoistway S car 1. The drive wheel 3 and the first diverting wheel(s) 4 are positioned to rotate parallelly on a vertical plane of rotation which is parallel with the side walls of the hoistway S and crosses the hoistway S at least substantially centrally.

Figure 2:
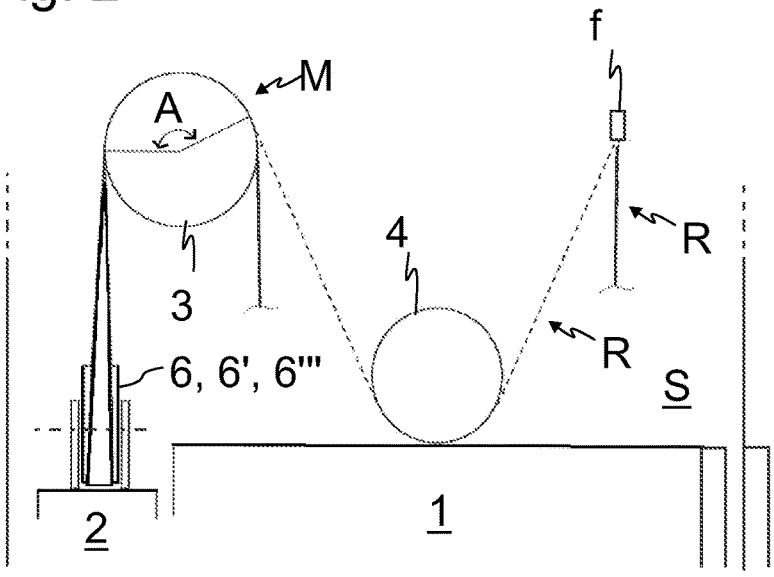
FIG. 2 illustrate views A-A of FIG. 1.
Figure 3:
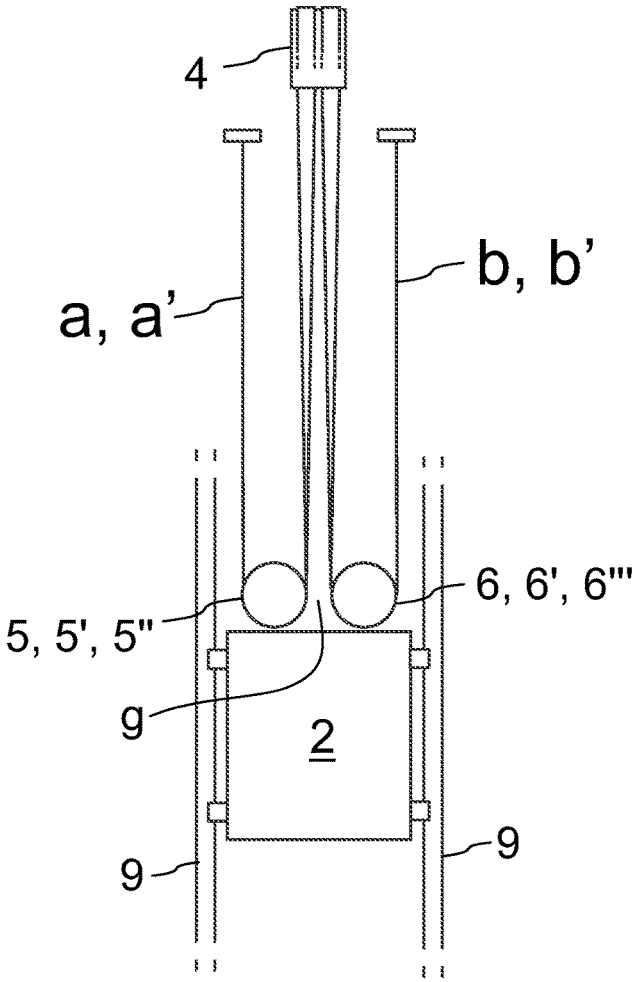
FIG. 3 illustrates view B-B of FIG. 1.

The roping R comprises a first belt-like rope a and a second belt-like rope b, each having a first end and a second end fixed to a stationary rope fixing f. The ropes being belt-like, they have width substantially larger than thickness thereof, which contributes in facilitating a small turning radius for the ropes a, b; a', b even though their load bearing members are made of rigid material and have a large cross-sectional area. Each of said ropes a and b, comprises one or more load bearing members 8, 8' made of fiber-reinforced composite material. The composite material has high bending resistance as its material characteristic, so the ropes comprising load bearing members made thereof tend to have a big turning radius. The disadvantages of this effect are in the preferred embodiment minimized by the particular layout as illustrated in FIGS. 1-3. Preferably, at the same time the internal structure of each rope as well as its shape is designed to contribute in minimizing this disadvantageous effect. The preferred alternatives for the internal structure of each rope a, b; a, b as well as the shape thereof are illustrated in FIGS. 4*a* and 4*b*.

As illustrated in FIGS. 1-3, in the preferred embodiment, the first rope a and the second rope b are more specifically arranged to pass parallelly side by side from the fixing f of the first end downwards to the elevator car 1; and to turn side by side under said first diverting wheel(s) 4; and to pass parallelly upwards to the drive wheel 3; and to turn side by side over the drive wheel 3; and to pass downwards to the counterweight 2, each rope a, b; a, b turning around its longitudinal axis said angle of 60 to 90 degrees (i.e. the same angle as said angle of the second and third diverting wheels 5, 6; 5', 6'; 5", 6"), and into the gap g between the rims of the second and third diverting wheel 5, 6; 5', 6'; 5", 6", the first rope a; a' passing to the second diverting wheel 5, 5', 5" and the second rope b; b' passing to the third diverting wheel 6, 6', 6", the first rope a; a' passing under the second diverting wheel 5, 5', 5" and the second rope b; b' passing under the third diverting wheel 6, 6', 6", the diverting wheels 5, 6; 5', 6'; 5", 6" rotating in opposite directions during elevator use and guiding the ropes a, b; a', b' arriving to them from the drive wheel (3) to turn away from each other; and to pass upwards to the fixing f of the second end.

Figure 4A:
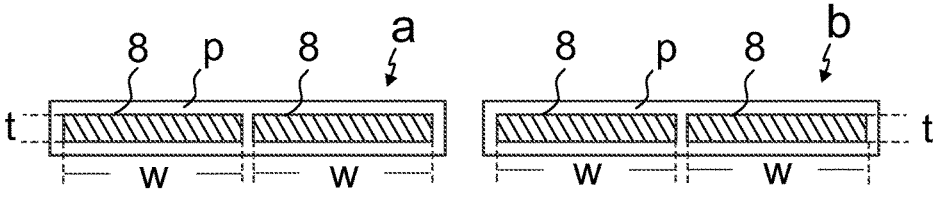
FIGS. 4*a* and 4*b* illustrate preferred alternative structures of the ropes.
Figure 4B:
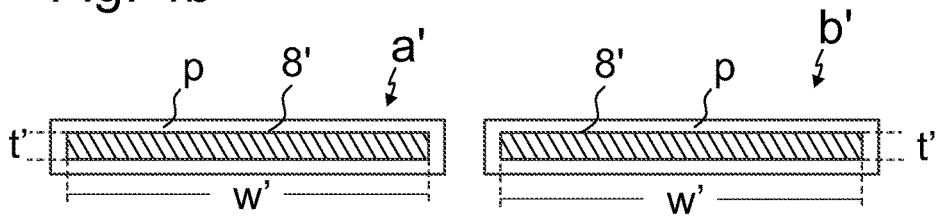

FIGS. 4*a* and 4*b* disclose preferred cross-sectional structures for the ropes a, b; a', b' as well as their preferred configuration relative to each other in the roping R when turning around the drive wheel 3. Thus, the ropes a, b; a', b' turn around the drive wheel 3 adjacent each other in width-direction of the rope a, b the wide sides of the belt-like ropes a, b; a', b' against the circumference of the drive wheel 3. Thereby, the bending direction of each rope a, b; a', b' is around an axis that is in the width direction of the rope a, b; a', b' (up or down in the FIGS. 4*a* and 4*b*) and with the illustrated ropes a, b; a', b' also in width direction of the force transmitting parts 8, 8' thereof. In these cases, the roping R comprises only these two ropes a and b; a' and b'.

A minimal number of ropes a and b; a' and b' comprised in the roping R leads to efficient utilization of the width of the roping R, thus making it possible to keep the diverting wheels 5 and 6; 5' and 6'; 5" and 6" small in their axial direction. Thus, they can be positioned on the counterweight 2 without substantially increasing the projection of the counterweight unit. The ropes could, however, formed alternatively to comprise a higher number of said load bearing members than what is shown in the figures.

Each rope a', b' as illustrated in FIG. 4*a* comprises a plurality (in this case two) of load bearing members 8. Each rope a', b' as illustrated in FIG. 4*b* comprises only one load bearing member 8'. The preferred internal structure for the load bearing member(s) 8, 8' is disclosed elsewhere in this application, in particular in connection with FIG. 5. The ropes a, b of FIG. 4*a* comprise each two load bearing members 8 of the aforementioned type adjacent in width-direction of the rope a, b. They are parallel in longitudinal direction and coplanar. Thus the resistance to bending in their thickness direction is small. The ropes a', b' of FIG. 4*b* comprise each only one load bearing member 8'.

The load bearing members 8, 8' of each rope is/are surrounded with a coating p in which the load bearing members 8, 8' are embedded. It provides the surface for contacting the drive wheel 3. Coating p is preferably of polymer, most preferably of an elastomer, most preferably polyurethane, and forms the surface of the rope a, b; a', b'. It enhances effectively the ropes frictional engagement to the drive wheel 3 and protects the rope a, b; a', b'. For facilitating the formation of the load bearing member 8, 8' and for achieving constant properties in the longitudinal direction it is preferred that the structure of the load bearing member 8, 8' continues essentially the same for the whole length of the rope a, b; a', b'.

As mentioned, the ropes a, b; a', b' are belt-shaped, particularly having two wide sides opposite each other. The width/thickness ratio of each rope a, b; a', b' is preferably at least at least 4, more preferably at least 5 or more, even more preferably at least 6, even more preferably at least 7 or more, yet even more preferably at least 8 or more. In this way a large cross-sectional area for the rope is achieved, the bending capacity around the width-directional axis being good also with rigid materials of the load bearing member. The aforementioned load bearing member 8 or a plurality of load bearing members 8', comprised in the rope, together cover majority, preferably 70% or over, more preferably 75% or over, most preferably 80% or over, most preferably 85% or over, of the width of the cross-section of the rope a, b; a', b' for essentially the whole length of the rope a, b; a', b'. Thus the supporting capacity of the rope with respect to its total lateral dimensions is good, and the rope does not need to be formed to be thick. This can be simply implemented with the composite as specified elsewhere in the application and this is particularly advantageous from the standpoint of, among other things, service life and bending rigidity. The width of the ropes is minimized by utilizing their width efficiently with wide force transmitting part and using composite material. Individual belt-like ropes and the bundle they form can in this way be formed compact. This thereby facilitates keeping the rope width in advantageous limits so that the diverting wheels 5 and 6 need not be formed large in their axial direction.

As mentioned earlier, the load bearing member(s) 8, 8' preferably have/has width (w, w') larger than thickness (t, t') thereof as measured in width-direction of the rope a, b; a', b'. In this way a large cross-sectional area for the load bearing member/parts is achieved, without weakening the bending capacity around an axis extending in the width direction. A small number of wide load bearing members comprised in the rope leads to efficient utilization of the width of the rope, thus making it possible to keep the rope width of the rope in advantageous limits so that the diverting wheels 5 and 6 need not be formed large in their axial direction. Thus, they can be positioned on the counterweight without substantially increasing the projection of the counterweight unit.

Figure 5:
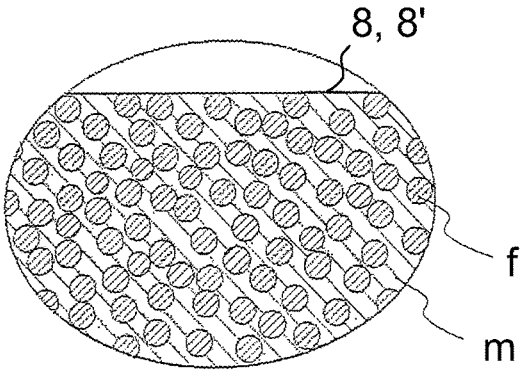
FIG. 5 illustrates a preferred internal structure for the load bearing member.

The inner structure of the load bearing member 8, 8' is more specifically as follows. The inner structure of the force transmitting part 8, 8' is illustrated in FIG. 5. The force transmitting part 8, 8' with its fibers is longitudinal to the rope, for which reason the rope retains its structure when bending. Individual fibers are thus oriented in the longitudinal direction of the rope. In this case the fibers are aligned with the force when the rope is pulled. Individual reinforcing fibers f are bound into a uniform load bearing member with the polymer matrix m. Thus, each load bearing member 8, 8' is one solid elongated rodlike piece. The reinforcing fibers f are preferably long continuous fibers in the longitudinal direction of the rope a, b; a', b', and the fibers f preferably continue for the distance of the whole length of the rope a, b; a', b'. Preferably as many fibers f as possible, most preferably essentially all the fibers f of the load bearing member 8, 8' are oriented in longitudinal direction of the rope. The reinforcing fibers f are in this case essentially untwisted in relation to each other. Thus the structure of the load bearing member can be made to continue the same as far as possible in terms of its cross-section for the whole length of the rope. The reinforcing fibers f are preferably distributed in the aforementioned load bearing member 8, 8' as evenly as possible, so that the load bearing member 8, 8' would be as homogeneous as possible in the transverse direction of the rope. An advantage of the structure presented is that the matrix m surrounding the reinforcing fibers f keeps the interpositioning of the reinforcing fibers f essentially unchanged. It equalizes with its slight elasticity the distribution of a force exerted on the fibers, reduces fiber-fiber contacts and internal wear of the rope, thus improving the service life of the rope. The reinforcing fibers being carbon fibers, a good tensile rigidity and a light structure and good thermal properties, among other things, are achieved. They possess good strength properties and rigidity properties with small cross sectional area, thus facilitating space efficiency of a roping with certain strength or rigidity requirements. They also tolerate high temperatures, thus reducing risk of ignition. Good thermal conductivity also assists the onward transfer of heat due to friction, among other things, and thus reduces the accumulation of heat in the parts of the rope. The composite matrix m, into which the individual fibers f are distributed as evenly as possible, is most preferably of epoxy resin, which has good adhesiveness to the reinforcements and which is strong to behave advantageously with carbon fiber. Alternatively, e.g. polyester or vinyl ester can be used. Alternatively some other materials could be used. FIG. 5 presents a partial cross-section of the surface structure of the load bearing member 8, 8' as viewed in the longitudinal direction of the rope a, b; a', b', presented inside the circle in the figure, according to which cross-section the reinforcing fibers f of the load bearing members 8, 8' are preferably organized in the polymer matrix m. FIG. 5 presents how the individual reinforcing fibers f are essentially evenly distributed in the polymer matrix m, which surrounds the fibers and which is fixed to the fibers f. The polymer matrix m fills the areas between individual reinforcing fibers f and binds essentially all the reinforcing fibers f that are inside the matrix m to each other as a uniform solid substance. In this case abrasive movement between the reinforcing fibers f and abrasive movement between the reinforcing fibers f and the matrix m are essentially prevented. A chemical bond exists between, preferably all, the individual reinforcing fibers f and the matrix m, one advantage of which is uniformity of the structure, among other things. To strengthen the chemical bond, there can be, but not necessarily, a coating (not presented) of the actual fibers between the reinforcing fibers and the polymer matrix m. The polymer matrix m is of the kind described elsewhere in this application and can thus comprise additives for fine-tuning the properties of the matrix as an addition to the base polymer. The polymer matrix m is preferably of a hard non-elastomer. The reinforcing fibers f being in the polymer matrix means here that in the invention the individual reinforcing fibers are bound to each other with a polymer matrix m e.g. in the manufacturing phase by embedding them together in the molten material of the polymer matrix. In this case the gaps of individual reinforcing fibers bound to each other with the polymer matrix comprise the polymer of the matrix. In this way a great number of reinforcing fibers bound to each other in the longitudinal direction of the rope are distributed in the polymer matrix. The reinforcing fibers are preferably distributed essentially evenly in the polymer matrix such that the load bearing member is as homogeneous as possible when viewed in the direction of the cross-section of the rope. In other words, the fiber density in the cross-section of the load bearing member does not therefore vary greatly. The reinforcing fibers f together with the matrix m form a uniform load bearing member, inside which abrasive relative movement does not occur when the rope is bent. The individual reinforcing fibers of the load bearing member 8, 8' are mainly surrounded with polymer matrix m, but fiber-fiber contacts can occur in places because controlling the position of the fibers in relation to each other in their simultaneous impregnation with polymer is difficult, and on the other hand, perfect elimination of random fiber-fiber contacts is not necessary from the viewpoint of the functioning of the invention. If, however, it is desired to reduce their random occurrence, the individual reinforcing fibers f can be pre-coated such that a polymer coating is around them already before the binding of individual reinforcing fibers to each other. In the invention the individual reinforcing fibers of the load bearing member can comprise material of the polymer matrix around them such that the polymer matrix m is immediately against the reinforcing fiber but alternatively a thin coating, e.g. a primer arranged on the surface of the reinforcing fiber in the manufacturing phase to improve chemical adhesion to the matrix m material, can be in between. Individual reinforcing fibers are distributed evenly in the load bearing member 8, 8' such that the gaps of individual reinforcing fibers f are filled with the polymer of the matrix m m. Most preferably the majority, preferably essentially all of the gaps of the individual reinforcing fibers f in the load bearing member are filled with the polymer of the matrix m. The matrix m of the load bearing member 8, 8' is most preferably hard in its material properties. A hard matrix m helps to support the reinforcing fibers f, especially when the rope bends, preventing buckling of the reinforcing fibers f of the bent rope, because the hard material supports the fibers f. To reduce the buckling and to facilitate a small bending radius of the rope, among other things, it is therefore preferred that the polymer matrix m is hard, and therefore preferably something other than an elastomer (an example of an elastomer rubber) or something else that behaves very elastically or gives way. The most preferred materials are epoxy resin, polyester, phenolic plastic or vinyl ester. The polymer matrix m is preferably so hard that its module of elasticity (E) is over 2 GPa, most preferably over 2.5 GPa. In this case the module of elasticity (E) is preferably in the range 2.5-10 GPa, most preferably in the range 2.5-3.5 GPa. Preferably over 50% of the surface area of the cross-section of the load bearing member is of the aforementioned reinforcing fiber, preferably such that 50%-80% is of the aforementioned reinforcing fiber, more preferably such that 55%-70% is of the aforementioned reinforcing fiber, and essentially all the remaining surface area is of polymer matrix m. Most preferably such that approx. 60% of the surface area is of reinforcing fiber and approx. 40% is of matrix m material (preferably epoxy). In this way a good longitudinal strength of the rope is achieved.

The elevator as illustrated, is of the type where the counterweight 2 travels vertically on the backside of the vertically traveling car 1, i.e. the car 1 travels vertically between the counterweight 2 and the landing doors D. The car 1 has also a door d on the side of the car 1 opening to the front direction. The elevator comprises guide rails 9 on opposite sides of the counterweight 2, guided by which the counterweight 2 is arranged to move. For this purpose the counterweight 2 comprises guide members 10 (such as a guide shoe or guide roller) traveling guided by the guide rails 9. Likewise, the elevator car 1 comprises guide rails 11 on opposite sides thereof, guided by which the elevator car 1 is arranged to move. For this purpose the elevator car 1 comprises guide members 12 (such as a guide shoe or guide roller) traveling guided by the guide rails 11.

Figure 6:
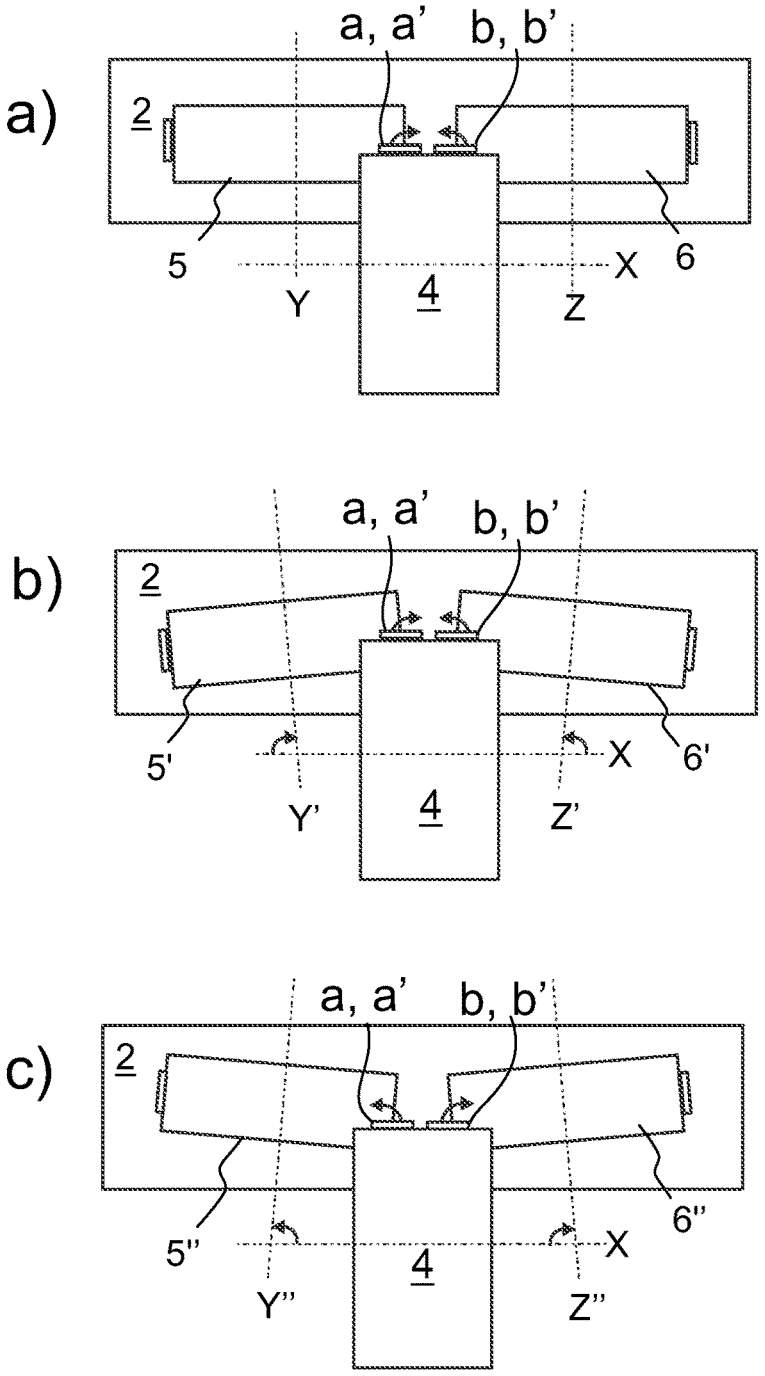
FIGS. 6*a*-6*c* illustrate preferred alternative layouts for the drive wheel and the second and third diverting wheels.

FIGS. 6*a* to 6*c* illustrate preferable alternatives for guiding the belt-like ropes a, b; a', b' from the drive wheel 3 to the diverting wheels 5 and 6; 5' and 6'; 5" and 6". In the preferred embodiments, as illustrated in FIGS. 6*a* to 6*c* the belt-like ropes a, b; a', b' turn around their longitudinal axes in opposite turning directions. Thus, their tendency to cause turning of the counterweight can be reduced. Thereby resistance caused by guidance as provided by guide rails 9 and guide means 10 mounted on the counterweight, for example, can be reduced.

As described above, the second and the third diverting wheel 5, 6 are mounted on the counterweight 2 radially side by side, each having a rotational axis, which is at an angle of 60 to 90 degrees relative to the rotational axis of the drive wheel 3. Thereby, each rope a, b passing downwards from the drive wheel 3 to the counterweight 2 turns around its longitudinal axis this angle of 60 to 90 degrees.

In FIG. 6*a* said angle of 60 to 90 degrees is 90 degrees. Thereby, the space consumption of the second and the third diverting wheel 5, 6 is minimized in the width direction c of the counterweight 2.

In FIGS. 6*b* and 6*c* said angle of 60 to 90 degrees is less than 90 degrees, in particular 85 degrees. It is preferable that said angle is less than 90 degrees so the risk of fracturing of the composite rope structure caused by the axial twist of the rope, can be reduced. However, so as to minimize the space consumption the angle should not be too small. Good results with regard to said space consumption with reduced risk of fractures in the composite rope structure are obtained when the angle is within the range of 60 to 85 degrees, the best results being obtained when the angle is within the range of 75-85 degrees.

In the alternative of FIG. 6*b*, where the belt-like ropes a, b; a', b' turn around their longitudinal axes in opposite turning directions, the first rope a; a' passes downwards turning clockwise and the second rope b; b' passes downwards turning counterclockwise said angle of 60 to 90 degrees when viewed from above. With this alternative, said angle of 60 to 90 degrees is with the second diverting wheel 5' an angle measured in clockwise direction and with the third diverting wheel 6' an angle measured in counter-clockwise direction with respect to the rotational axis X of the drive wheel (when viewed from above). Thereby, good results with regard to space consumption with reduced risk of fractures in the composite rope structure are obtained. Also, the suspension of the counterweight can thus be formed substantially central and without tendency to turn so that guiding resistance is increased.

In the alternative of FIG. 6*c*, where the belt-like ropes a, b; a', b' turn around their longitudinal axes in opposite turning directions, the first rope a; b' passes downwards turning counterclockwise and the second rope b; b' passes downwards turning clockwise said angle of 60 to 90 degrees (when viewed from above). With this alternative, said angle of 60 to 90 degrees is with the second diverting wheel 5" an angle measured in counter-clockwise direction and with the third diverting wheel 6" an angle measured in clockwise direction with respect to the rotational axis of the drive wheel X (when viewed from above). Thereby, good results with regard to space consumption with reduced risk of fractures in the composite rope structure are obtained. Also, the suspension of the counterweight can thus be formed substantially central and without tendency to turn so that guiding resistance is increased.

In the preferred embodiment the drive wheel 3 is mounted in the top end of the hoistway S. Therefore, a space efficient suspension of the car 1 needs to be provided so as to ensure a low head space of the hoistway S. A simple and at the same time space efficient head space is facilitated such that the first diverting wheel(s) 4 are mounted on top of the car 1 substantially at the center of the vertical projection thereof. Each rope a, b; a', b' passes between the fixing f and the drive wheel 3 around one wheel 4 mounted centrally on top of the car 1, and no other wheels. This means that the contact angle of the ropes a, b; a', b' around the drive wheel 3 changes as function of car position. The drive wheel is mounted above an edge of the car such that their vertical projections only partly overlap. The ropes a, b; a', b' pass at least substantially straight downwards from the drive wheel 3. This setting gives a contact angle A of roughly 180 degrees when the car 1 is at its downmost position and a contact angle A substantially less than 180 degrees when the car 1 is at its topmost position. This is made possible with the high traction provided by the belt-like form of the ropes a, b; a', b' as the belt-like form enables adequate contact surface to prevent slippage of the ropes a, b; a', b' when the contact angle is at minimum. In FIG. 2 the path of the ropes are illustrated with a dashed line when the car 1 is at its topmost position and with solid line when in its lowermost position. The counterweight 2 is illustrated in its topmost position. The fixings f are preferably mounted in the top end of the hoistway S as well. The fixing f of the first end of each rope is mounted in such position that the ropes a, b; a', b' pass symmetrically relative to the axis W between the fixing f of the first end and between the drive wheel 3.

In a preferred embodiment, the second and third diverting wheels, i.e. the rope receiving circumference thereof, have diameters as large as 30 to 70 cm, most preferably 30 to 50 cm. With this size of diameter for most elevator installations in the low-rise product range a turning radius suitable for composite rope as defined is provided at the same time providing an adequate load bearing ability. Corresponding diameter range is preferable for the other wheels 3 and 4 as well, as this reduces the changing of angle A in function of car position, as well as provides a vast contact area, thus facilitating good traction.

The belt-like ropes a, b; a', b' may be engaged by the drive wheel by matching contoured shapes (not showed). In that case, the matching shapes preferably are so called polyvee shapes or teeth, whereby each of said ropes a, b; a', b' has at least one contoured side provided with guide ribs and guide grooves oriented in the longitudinal direction of the rope a, b or teeth oriented in the cross direction of the rope, said contoured side being fitted to pass against a circumference of the drive wheel 3 contoured in a matching way i.e. so that the shape of the circumference forms a counterpart for the shapes of the ropes. This kind of matching contoured shapes are advantageous especially for making the engagement firmer and less likely to slip. The surfaces of the belt-like ropes a, b; a, b as well as the surface of the drive wheel can, however, be smooth as illustrated in the Figures. In that case, each of said rope a, b may have a wide and smooth side without guide ribs or guide grooves or teeth fitted to pass against a cambered smooth circumference of the drive wheel 3.

In this application, the term load bearing member refers to the part that is elongated in the longitudinal direction of the rope a, b; a', b' continuing throughout all the length thereof, and which part is able to bear without breaking a significant part of the tensile load exerted on the rope in question in the longitudinal direction of the rope. The tensile load can be transmitted inside the load bearing member all the way from its one end to the other, and thereby can transmit tension from the drive wheel 3 to elevator car 1, as well as from the drive wheel 3 to the counterweight 2 respectively.

As described above said reinforcing fibers f are carbon fibers. However, alternatively also other reinforcing fibers can be used. Especially, glass fibers are found to be suitable for elevator use, their advantage being that they are cheap and have good availability although a mediocre tensile stiffness.

It is preferable, that the elevator comprises only the aforementioned drive machine M, as no other drive machines are needed. Respectively, the elevator comprises only said roping passing around a drive wheel, as no other ropings passing around a drive wheel are needed.

In the illustrated embodiments, an elevator of a so called rear-counterweight-type is shown, where the counterweight 2 travels vertically on the backside of the vertically traveling car 1, i.e. the car 1 travels vertically between the counterweight 2 and the landing door D. However, the solution suits well also for an elevator of a so called side-counterweight-type. In that case, the landing door would be positioned on either side of the hoistway, the guide rails 11 the being positioned differently.

In the illustrated embodiments, the roping comprises only two ropes a and b; a' and b', thus providing a space efficient turning of the ropes at the counterweight 2. However, in the broadest sense of the invention a different number of ropes could be utilized, in which case each first belt-like rope could be substituted with two or more belt-like ropes and each second belt-like rope with two or more belt-like ropes, respectively.

It is to be understood that the above description and the accompanying Figures are only intended to illustrate the present invention. It will be apparent to a person skilled in the art that the inventive concept can be implemented in various ways. The invention and its embodiments are not limited to the examples described above but may vary within the scope of the claims.

The invention claimed is:

1. An elevator comprising:

an elevator car;

a counterweight;

a drive wheel mounted stationary, and having a rotational axis;

first diverting wheel(s), mounted on the elevator car, and having a rotational axis parallel with the rotational axis of the drive wheel;

a second diverting wheel and a third diverting wheel mounted on the counterweight radially side by side, the second and third diverting wheels having a rotational axis different from each other, and each of the second and third diverting wheels is at an angle of 60 to 90 degrees relative to the rotational axis of the drive wheel; and a roping suspending the elevator car and counterweight and comprising a first rope and a second rope, each of the first and second ropes having a first end fixed to a first stationary rope fixing and a second end fixed to second and third stationary rope fixings, respectively, and each of the first and second ropes comprising one or more load bearing members made of fiber-reinforced composite material, wherein the first rope and the second rope are located adjacent one another from the first stationary rope fixing downwards to the elevator car in a direction towards a bottom of a hoistway of the elevator, under said first diverting wheels, pass upwards to the drive wheels in a direction towards the top the hoistway, and are located adjacent one another over the drive wheels, pass downwards to the counterweight, each rope turning around its longitudinal axis an angle of said 60 to 90 degrees, and into a gap between rims of the second and third diverting wheel, the first rope passing to the second diverting wheel and the second rope passing to the third diverting wheel, the first rope passing under the second diverting wheel and the second rope passing under the third diverting wheel, the second and third diverting wheels rotating in opposite directions guiding the ropes to turn away from each and pass upwards to the second and third stationary rope fixings, respectively, wherein each of said load bearing member(s) has a width larger than a thickness thereof as measured in a width-direction of the rope, and wherein each of the second and third diverting wheels, have a diameter of 30 to 70 cm.

2. The elevator according to claim 1, wherein said fiber-reinforced composite material comprises reinforcing fibers in polymer matrix.

3. The elevator according to claim 2, wherein said one or more load bearing members is/are embedded in elastomeric coating.

4. The elevator according to claim 1, wherein said one or more load bearing members is/are embedded in elastomeric coating.

5. The elevator according to claim 1, wherein the roping comprises only said two ropes.

6. The elevator according to claim 1, wherein the drive wheel is mounted at a top end of the hoistway in which the car and the counterweight travel.

7. The elevator according to claim 1, wherein the counterweight travels vertically on a backside of the vertically traveling car.

8. The elevator according to claim 1, wherein the ropes pass from the drive wheel turning around their longitudinal axes in opposite turning directions.

9. The elevator according to claim 1, wherein said angle of 60 to 90 degrees is 60 to 85 degrees.

10. The elevator according to claim 9, wherein the first rope passes downwards turning clockwise and the second rope passes downwards turning counterclockwise, and said angle of 60 to 85 degrees is with the second diverting wheel an angle measured in clockwise direction and with the third diverting wheel an angle measured in counter-clockwise direction with respect to the rotational axis of the drive wheel.

11. The elevator according to claim 9, wherein the first rope passes downwards turning counterclockwise and the second rope passes downwards turning clockwise, and said angle of 60 to 85 degrees is with the second diverting wheel an angle measured in counter-clockwise direction and with the third diverting wheel an angle measured in clockwise direction with respect to the rotational axis of the drive wheel.

12. The elevator according to claim 1, wherein said angle of 60 to 90 degrees is 90 degrees.

13. The elevator according to claim 1, wherein the roping comprises exactly two of said ropes passing around the drive wheel adjacent each other in width-direction of the rope, wherein wide sides of the ropes are against the drive wheel.

14. The elevator according to claim 1, wherein each of said rope(s) comprises a plurality of said load bearing members adjacent in width-direction of the rope.

15. The elevator according to claim 1, wherein said angle of 60 to 90 degrees is 75 to 85 degrees.

16. The elevator according to claim 1, wherein each of the second and third diverting wheels, have a diameter of 30 to 50 cm.

* * * * *